US006715694B2

(12) United States Patent
Gebhardt

(10) Patent No.: US 6,715,694 B2
(45) Date of Patent: Apr. 6, 2004

(54) CONTROL VALVE BODY FOR AN OIL ACTIVATED FUEL INJECTOR

(75) Inventor: Jens Gebhardt, Columbia, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 252 days.

(21) Appl. No.: 09/899,218

(22) Filed: Jul. 6, 2001

(65) Prior Publication Data

US 2003/0006298 A1 Jan. 9, 2003

(51) Int. Cl.[7] ..... F02M 47/02

(52) U.S. Cl. ..... 239/89; 239/88; 239/90; 239/96; 239/124; 137/625.65

(58) Field of Search ..... 239/88, 89, 90, 239/92, 96, 584, 124, 585.1; 123/446; 251/48, 51, 50, 52; 137/625.65, 625.66

(56) References Cited

U.S. PATENT DOCUMENTS

| | | | | |
|---|---|---|---|---|
| 4,979,674 A | | 12/1990 | Taira et al. | |
| 5,460,329 A | | 10/1995 | Sturman | |
| 5,479,901 A | * | 1/1996 | Gibson et al. | 137/625.65 |
| 5,954,030 A | * | 9/1999 | Sturman et al. | 123/446 |
| 5,964,406 A | | 10/1999 | Zuo | |

* cited by examiner

*Primary Examiner*—Steven J. Ganey
(74) *Attorney, Agent, or Firm*—McGuireWoods LLP

(57) ABSTRACT

An oil activated fuel injector control valve which reduces bouncing of the spool and an impact of the spool on an open coil. This eliminates shot by shot variations in the fuel injector as well as increasing the efficiency of the fuel injector. The fuel injector includes a valve control body which has a vent holes which prevent air from mixing with the working fluid. In this manner, the working fluid does not have to compress and/or dissolve the air in the working ports prior to acting on the piston and plunger mechanism in an intensifier body of the fuel injector.

17 Claims, 12 Drawing Sheets

REPORT LOCATION D:\VENTIL TESTS\07593\GROOVE DESIGN\SECOND GROOVE DESIGN (BEST RESULTS)\[COMPARISION ORIGINAL TO GROOVE SECOND DESIGN 1mm HOLE.XLS]FUEL MAP (PULSEWIDTH)

| | | | | | | |
|---|---|---|---|---|---|---|
| INJECTOR NO. | STANDARD INJECTOR | ENGINE SPEED (CRANK) | 1500 | [R.P.M.] | CALIBRATION FLUID | ISO 4113 |
| INJECTOR TYPE | STANDARD | PUMP SPEED | 1000 | [R.P.M.] | ENGINE OIL | 15W40 |
| NUMBER OF SHOTS | 50 | ENGINE OIL TEMP. | 75/167 | [°C/°F] | BENCH | F2 |
| DATE | 02/09/2001 | CALIBRATION FLUID TEMP. | 40/104 | [°C/°F] | TECHNICIAN | JeGe |
| INJECTOR NO. | DAMPED INJECTOR | ENGINE SPEED (CRANK) | 1500 | [R.P.M.] | CALIBRATION FLUID | ISO 4113 |
| INJECTOR TYPE | DAMPED IN | PUMP SPEED | 1000 | [R.P.M.] | ENGINE OIL | 15W40 |
| NUMBER OF SHOTS | 50 | ENGINE OIL TEMP. | 75/167 | [°C/°F] | BENCH | F3 |
| DATE | 02/21/2001 | CALIBRATION FLUID TEMP. | 40/104 | [°C/°F] | TECHNICIAN | JeGe |

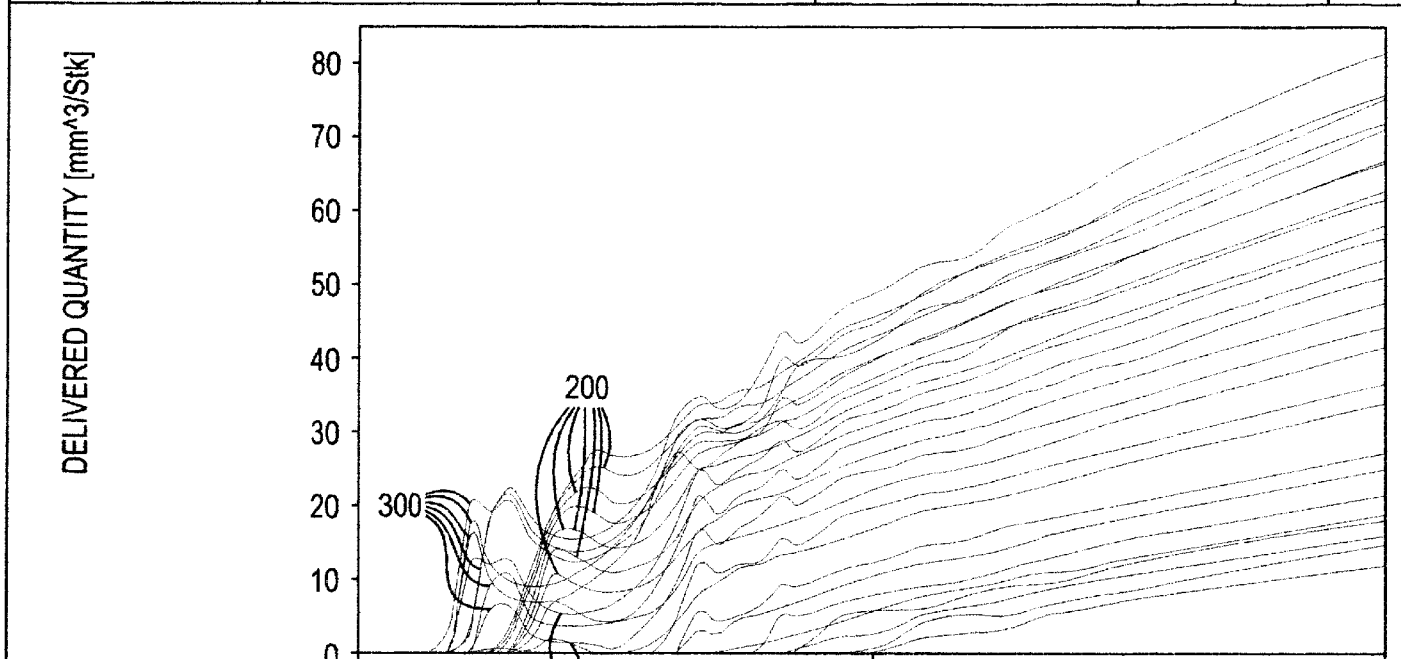

FIG. 6

CONTROL VALVE BODY FOR AN OIL ACTIVATED FUEL INJECTOR

BACKGROUND OF THE INVENTION

1. Field of the Invention

The present invention generally relates to an oil activated fuel injector and, more particularly, to a valve control body used with an oil activated electronically or mechanically controlled fuel injector having a spool head which reduces shot to shot fuel variations and other injector inefficiencies.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

In conventional fuel injectors, a driver first delivers a current or voltage to an open side of an open coil solenoid. The magnetic force generated in the open coil solenoid will shift a spool into the open position so as to align grooves or orifices (hereinafter referred to as "grooves") of the control valve body and the spool. During this shifting of the spool, the spool impacts against the open coil solenoid thus causing a bounding the spool head, itself, against the open coil solenoid. This is especially true at high spool speeds. This spool bouncing may lead to high shot to shot fuel variation and non-linear behavior of the injection quantities at low open coil activation times. This problem appears to be especially acute during the injection of pilot quantities of fuel.

Once there is an alignment of the grooves, the working fluid flows into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

To end the injection cycle, the driver delivers a current or voltage to a closed side of a closed coil solenoid. The magnetic force generated in the closed coil solenoid then shifts the spool into the closed or start position which, in turn, closes the working ports of the control valve body. The working fluid pressure will then drop in the intensifier and high-pressure chamber such that the needle spring will shift the needle to the closed position. The nozzle tip, at this time, will close the injection holes and end the fuel injection process. At this stage, the working fluid is then vented from the fuel injector via vent holes surrounding the control valve body.

The present invention is directed to overcoming one or more of the problems as set forth above.

SUMMARY OF THE INVENTION

In a first aspect of the present invention, a control valve body is provided for use with a fuel injector. The control valve body includes an inlet area and working ports. A spool has at least one communication port which provides fluid communication between the inlet area and the working ports. At least one fluid passage within the spool provides fluid communication between the at least one of the working ports and a gap formed between the spool and a coil which is adapted to shift the spool.

In another aspect of the present invention, an oil inlet area and at least one port in fluid communication with the oil inlet area is provided. The at least one port is adapted for transporting oil between the oil inlet area and an intensifier chamber of the fuel injector. An aperture having at least one communication port is positioned about a surface of the aperture which provides a flow path for the oil between the at least one port and the oil inlet area. A spool is positioned within the aperture and slidable between a first position and a second position, and includes at least one communication port which is in alignment with the at least one communication port of the aperture when the spool is in the first position. First and second coils are also provided. At least one fluid passage is provided in the spool and a dampening groove is positioned at the second end of the spool in fluid contact with the oil within the gap.

In still another aspect of the present invention, a spool is provided with a shaft having a first end and a second end, and a dampening groove at one of the ends. A fluid communication path is provided about a portion of the shaft, and at least one longitudinal bore is provided throughout the shaft. At least one hole is in fluid communication with the at least one longitudinal bore.

In also another aspect of the present invention, an oil activated fuel injector is provided. The injector includes a valve control body which has (i) an oil inlet area, (ii) at least one port, (iii) an aperture having at least one communication port positioned about a surface of the aperture and (iv) a spool slidable between a first position and a second position. The spool includes at least one communication port and at least one fluid passage providing a fluid passage for the oil between the port and a gap formed between the spool and a coil. The spool also includes a dampening groove. The injector further includes an intensifier body mounted to the valve control body, a piston slidably positioned within centrally located bore of the intensifier body and a plunger. An intensifier spring surrounds the shaft of the plunger and is further positioned between the piston and a shoulder of the intensifier body. A high pressure fuel chamber is formed at the second end of the plunger and a nozzle is in fluid communication with the high pressure chamber. A needle is positioned within the nozzle, and a fuel chamber surrounds the needle and in fluid communication with the fuel bore.

BRIEF DESCRIPTION OF THE DRAWINGS

The foregoing and other objects, aspects and advantages will be better understood from the following detailed description of a preferred embodiment of the invention with reference to the drawings, in which:

FIG. 6 shows a pulse-width-diagram comparing the oil activated fuel injector of the present invention to a conventional fuel injector.

DETAILED DESCRIPTION OF A PREFERRED EMBODIMENT OF THE INVENTION

The present invention is directed to an oil activated electronically, mechanically or hydraulically controlled fuel injector which is capable of substantially decreasing and/or preventing spool bouncing during the fuel injection process. The present invention is capable of decreasing shot to shot variations in fuel injection at low fuel quantities thus increasing the predictability of the fuel injector throughout a range of hydraulic oil pressures. This increased predictability also leads to increased fuel efficiency even at lower fuel quantities. The present invention is also capable of significantly reducing mechanical noise, as well as reducing the wear on the fuel injector due to frictional forces. The present invention accomplishes these and other advantages by providing working fluid within a gap formed between the spool and the open coil via holes and passages formed within the spool. During the injection cycle, the working fluid will reduce the speed (and hence bouncing) of the spool, when the open coil is energized, by providing a dampening effect to the spool when shifted towards the open coil.

Oil Activated Fuel Injector of the Present Invention

Figure 1:
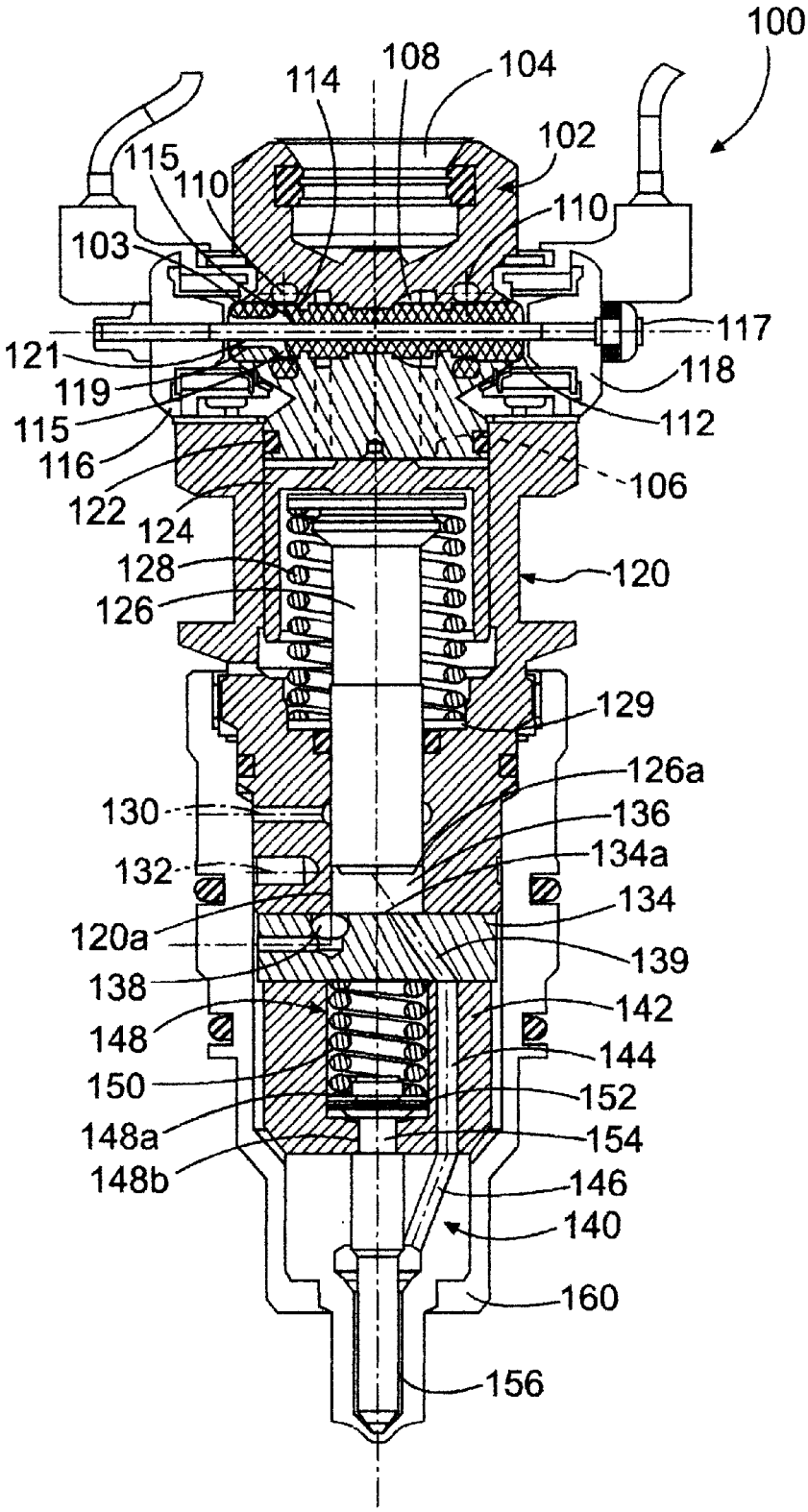
FIG. 1 shows a valve control body of the present invention used with an illustrative fuel injector.

Referring to FIG. 1, a fuel injector implementing the spool design of the present invention is shown. The fuel injector shown in FIG. 1 is one fuel injector which may be used with the present invention, but should not be interpreted to be the only fuel injector design which can be implemented with the spool of the present invention. Accordingly, other types of fuel injectors may also be used with the spool/valve control body described herein, and hence the spool of the present invention should not be limited in its use to the fuel injector shown in FIG. 1. It is noted that the spool forms the control body of the present invention.

Now, the fuel injector is generally depicted as reference numeral 100 and includes a valve control body 102 as well as an intensifier body 120 and a nozzle 140. The valve control body 102 includes an inlet area 104 which is in fluid communication with working ports 106, and further includes a notch 103. At least one groove or orifice (hereinafter referred to as grooves) 108 is positioned between and is in fluid communication with the inlet area 104 and the working ports 106. At least one vent hole 110 (and preferably two ore more) is located in the valve control body 102 which is in fluid communication with the working ports 106.

A spool 112 having at least one groove or orifice (hereinafter referred to as grooves) 114 is slidably mounted within the valve control body 102. An open coil 116 and a closed coil 118 are positioned on opposing sides of the spool 112 and are energized via a driver (not shown) to drive the spool 112 between a closed position and an open position. In the open position, the grooves 114 of the spool 112 are aligned with the grooves 108 of the valve control body 102 thus allowing the working fluid to flow between the inlet area 104 and the working ports 106 of the valve control body 102. A screw or other fastening device 117, positioned along a longitudinal bore of the spool 112, securely fastens the open and closed coils 116 and 118, as well as the spool 112 to the valve control body 102. At least one additional hole 115 is provided in the spool 112, and a passage 119 is provided between the screw or fastening device 117 and the spool 112. The at least one additional hole 115 is in fluid communication with the working port 106, and may also be in fluid communication with the open coil side groove 108. The passage 119, on the other hand, provides fluid communication between the at least one hole 115 and a gap 121 which forms between the end of the spool 112 and the open coil 116. In embodiments, the gap 121 may be formed when the spool 112 shifts towards the closed coil 118 at which time the working fluid from the intensifier will flow through the hole 115, through the passage 119 and into the gap 121. The hole 115 and the vent holes 110 may share working fluid which flows from the intensifier (a main portion of the working fluid flows through the vent holes 110 and a small amount flows through the holes 115 of the spool 112). In embodiments, working fluid will not flow into the gap formed in the closed coil 118 side since there is no pressure in the vent hole 110 or the hole 115.

Still referring to FIG. 1, the intensifier body 120 is mounted to the valve control body 102 via any conventional mounting mechanism. A seal 122 (e.g., o-ring) may be positioned between the mounting surfaces of the intensifier body 120 and the valve control body 102. A piston 124 is slidably positioned within the intensifier body 120 and is in contact with an upper end of a plunger 126. An intensifier chamber 125 is formed between the piston 124 and the valve control body 102 when the piston 124 is forced away from the facing surface of the valve control body (discussed below). An intensifier spring 128 surrounds a portion (e.g., shaft) of the plunger 126 and is further positioned between the piston 124 and a flange or shoulder 129 formed on an interior portion of the intensifier body 120. The intensifier spring 128 urges the piston 122 and the plunger 126 in a first position proximate to the valve control body 102. A plurality of venting and pressure release holes 130 and 132, respectively, are formed in the body of the intensifier body 120. The plurality of venting and pressure release holes 130 and 132 are further positioned adjacent the plunger 126.

A check disk 134 is positioned below the intensifier body 120, remote from the valve control body 102. The combination of an upper surface 134*a* of the check disk 134, an end portion 126*a* of the plunger 126 and an interior wall 120*a* of the intensifier body 120 forms a high pressure chamber 136. A fuel inlet check valve 138 is positioned within the check disk 134 and provides fluid communication between the high pressure chamber 136 and a fuel area (not shown). This fluid communication allows fuel to flow into the high pressure chamber 136 from the fuel area during an up-stroke of the plunger 126. The pressure release hole 132 is also in fluid communication with the high pressure chamber 136 when the plunger 126 is urged into the first position; however, fluid communication is interrupted when the plunger 126 is urged downwards towards the check disk 134. The check disk 134 also includes an angled fuel bore 139 in fluid communication with the high pressure chamber 136.

FIG. 1 further shows the nozzle 140 and a spring cage 142. The spring cage 142 is positioned between the nozzle 140 and the check disk 134, and includes a straight fuel bore 144 in fluid communication with the angled fuel bore 139 of the check disk 134. The spring cage 142 also includes a centrally located bore 148 having a first bore diameter 148*a* and a second smaller bore diameter 148*b*. A spring 150 and a spring seat 152 are positioned within the first bore diameter 148*a* of the spring cage 142, and a pin 154 is positioned within the second smaller bore diameter 148*b*. The nozzle 140 includes a second angled bore 146 in alignment with the straight bore 139 of the spring cage 142. A needle 150 is located with the nozzle 140 and is urged downwards by the spring 150 (via the pin 154). A fuel chamber 152 surrounds the needle 150 and is in fluid communication with the angled bore 146. In embodiments, a nut 160 is threaded about the intensifier body 120, the check disk 134, the nozzle 140 and the spring cage 142.

Figure 2:
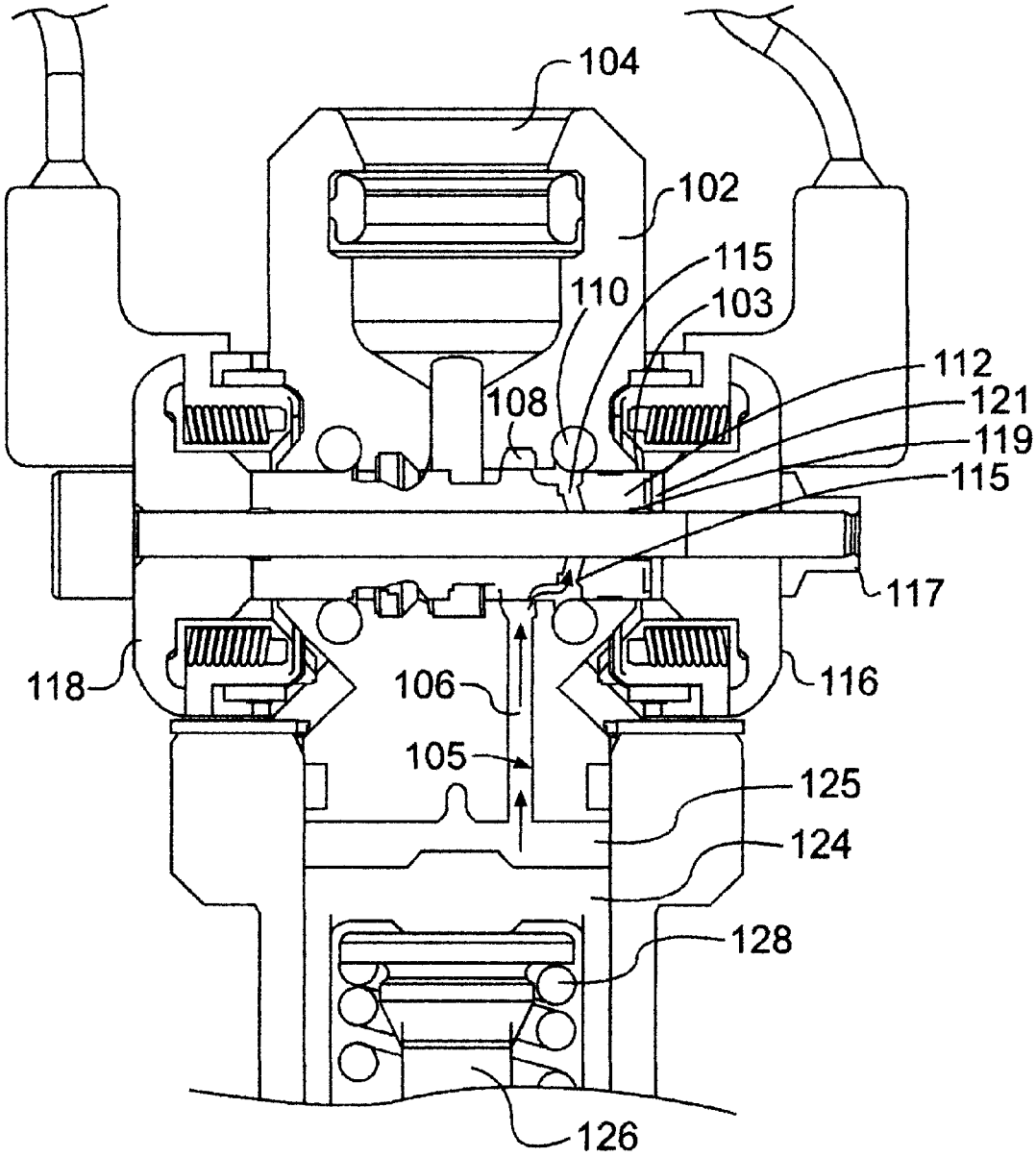
FIG. 2 shows an exploded cross sectional view of the valve control body of FIG. 1 with the spool in the closed or start position.

FIG. 2 shows an exploded cross sectional view of the valve control body 102 of FIG. 1 with the spool 112 in the closed or start position. In FIG. 2, the working fluid 105 is shown to be in fluid communication between (i) the intensifier chamber 125, (ii) the working ports 106, (iii) the fluid passage 115 and 119 and (iv) the gap 121 between the spool 112 and the open coil 116. This occurs when the spool 112 shifts towards the closed coil 118. The working fluid 105 is also vented to the reservoir of the control valve via the vent holes 110. The spool 112 also includes a damping groove (better shown in FIG. 3).

Figure 3:
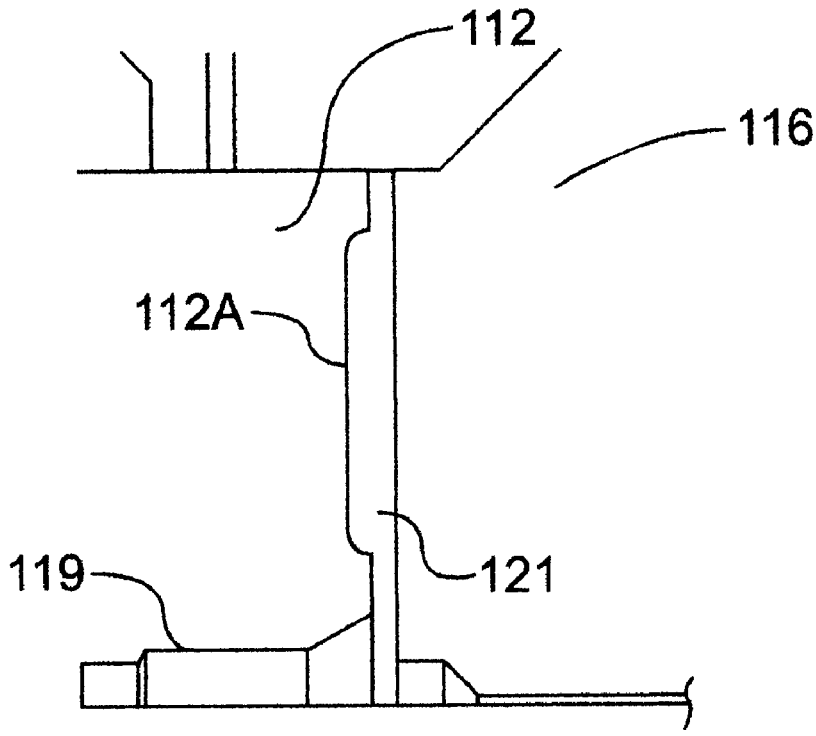
FIG. 3 shows an exploded view of a lower portion of the spool and a portion of the open coil.

FIG. 3 shows an exploded view of an upper portion of the spool 112 and a portion of the open coil 116. In this figure, the damping groove 112*a* of the spool 112 is positioned within the gap 121 and is in fluid communication with the working fluid. Also, the passage 119 is shown to be in fluid communication with the gap 121.

Figure 4:
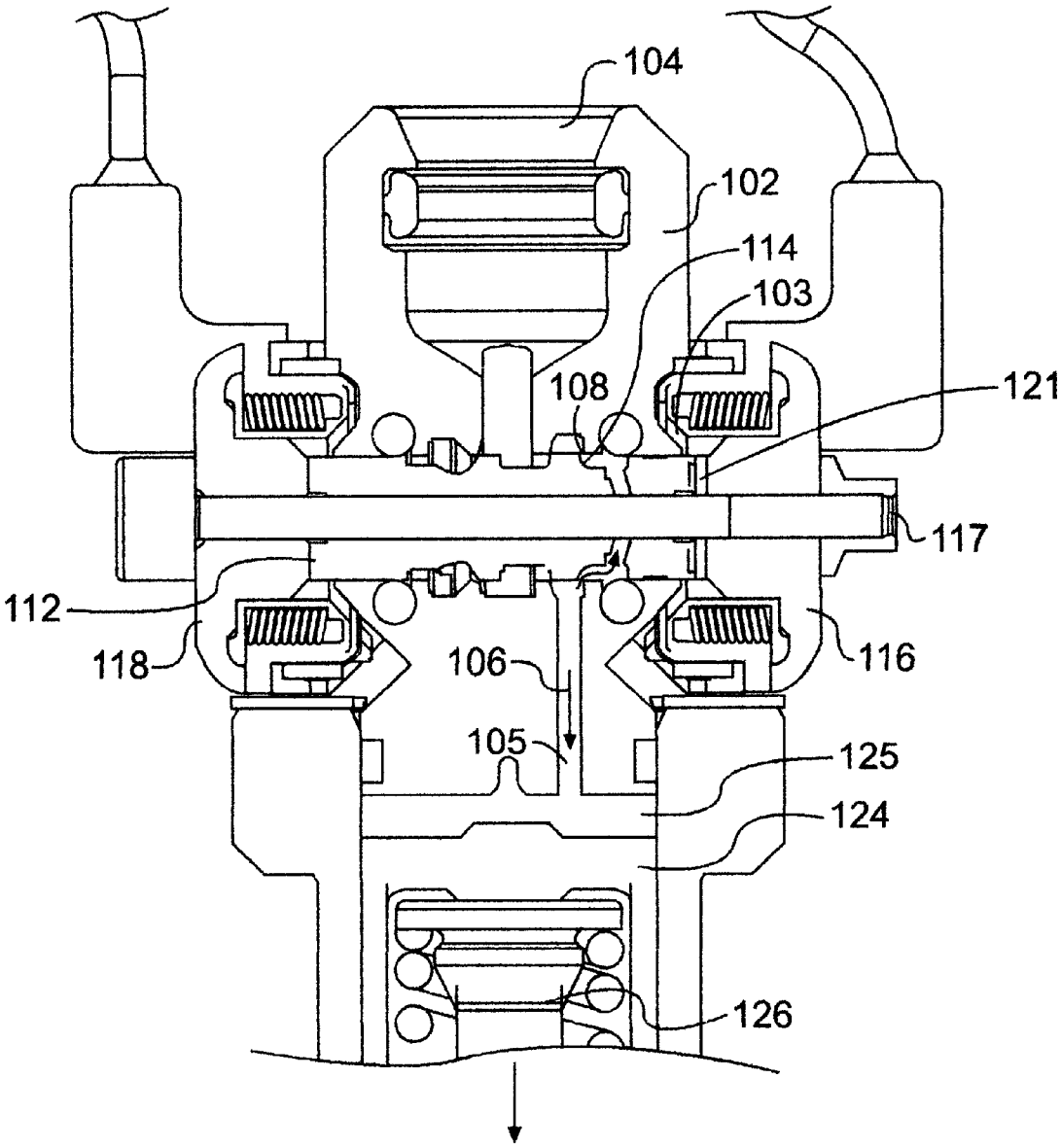
FIG. 4 shows the valve control body with the spool in an open position (open stroke of the injector)
Figure 5A:
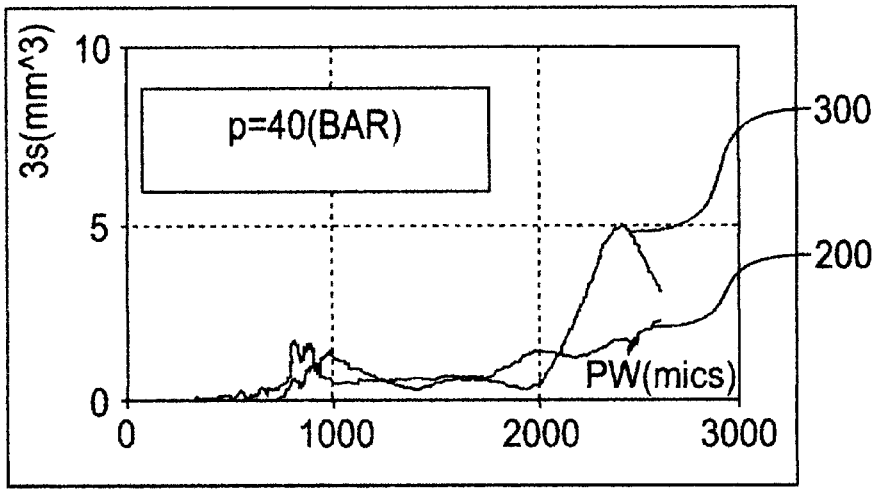
FIGS. 5*a*–5*m* show charts depicting several tests of a conventional fuel injector (of known design) and the oil activated fuel injector of the present invention at several testing pressures ranging from 40 bars to 240 bars.
Figure 5B:
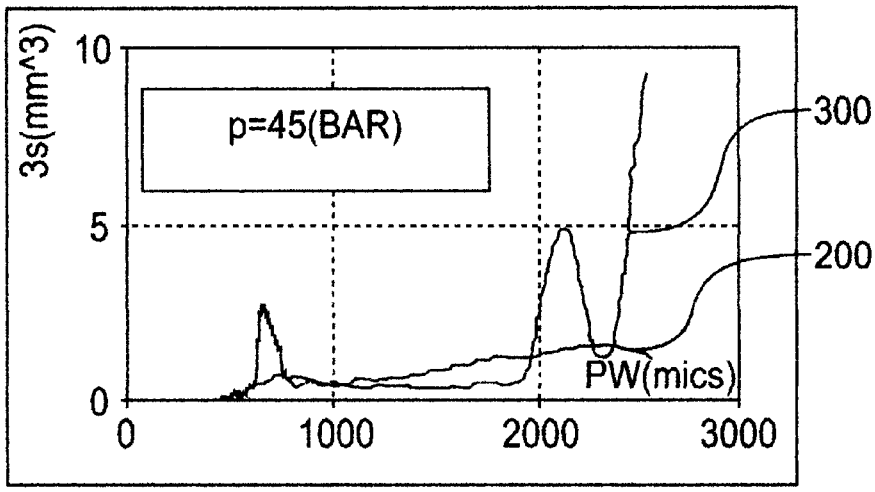
Figure 5C:
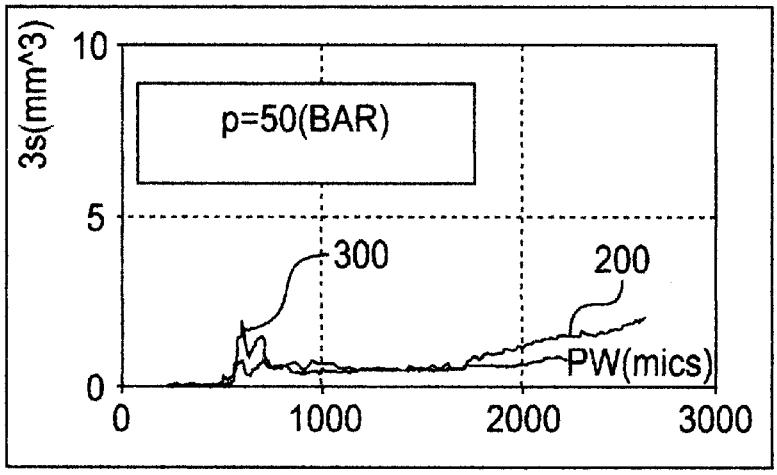
Figure 5D:
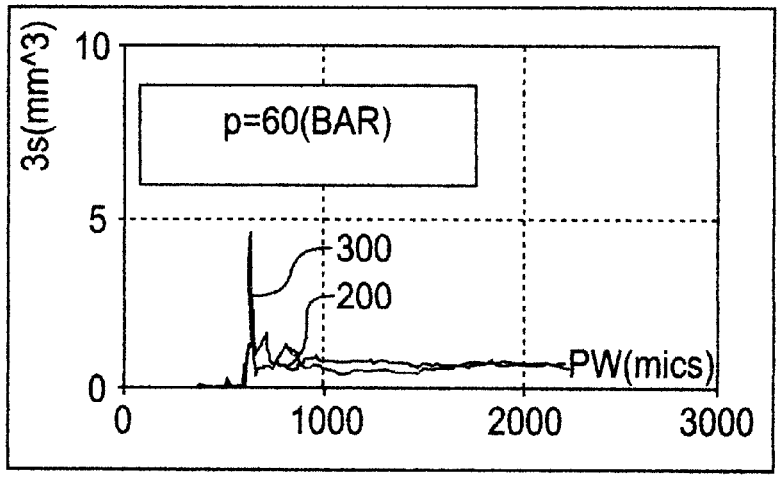
Figure 5E:
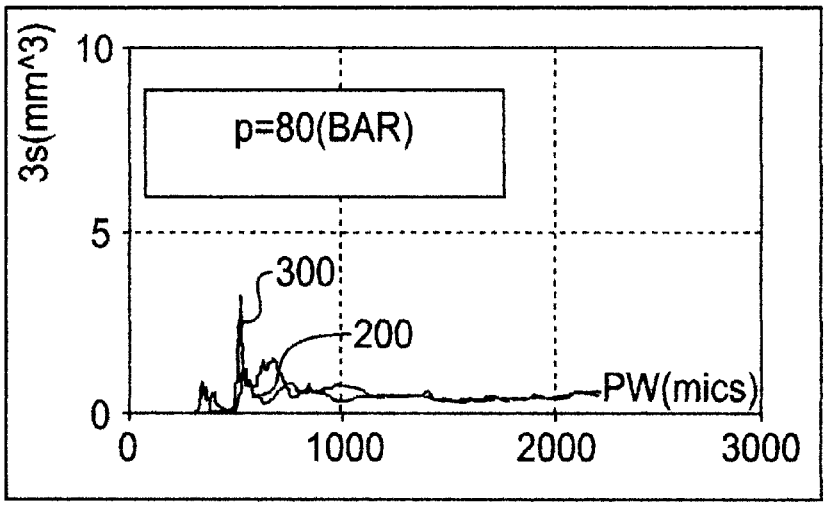
Figure 5F:
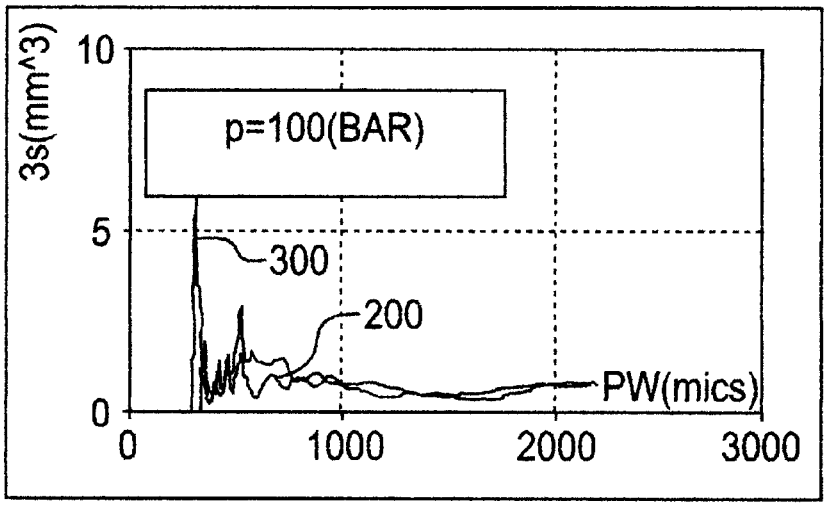
Figure 5G:
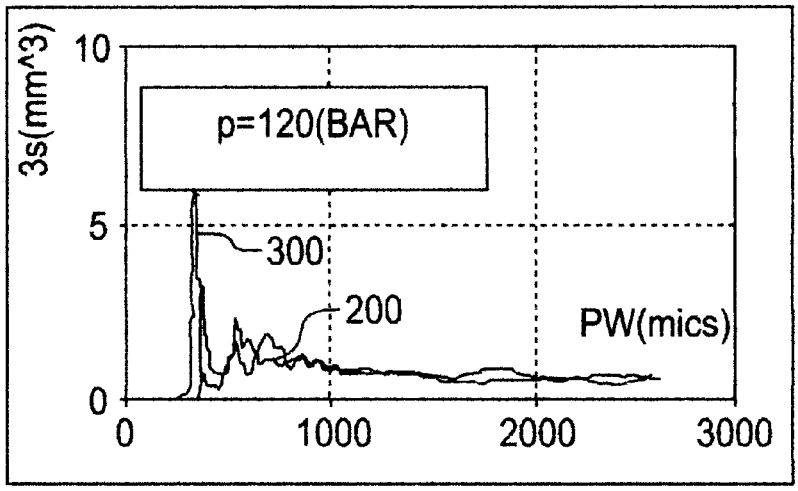
Figure 5H:
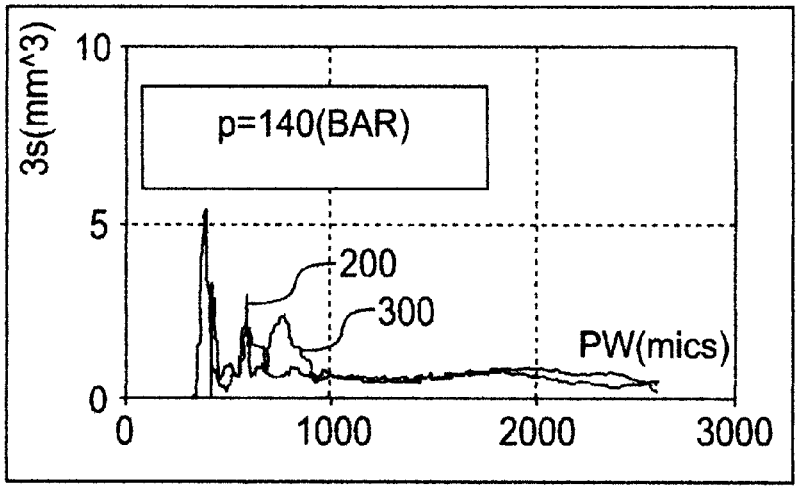
Figure 5I:
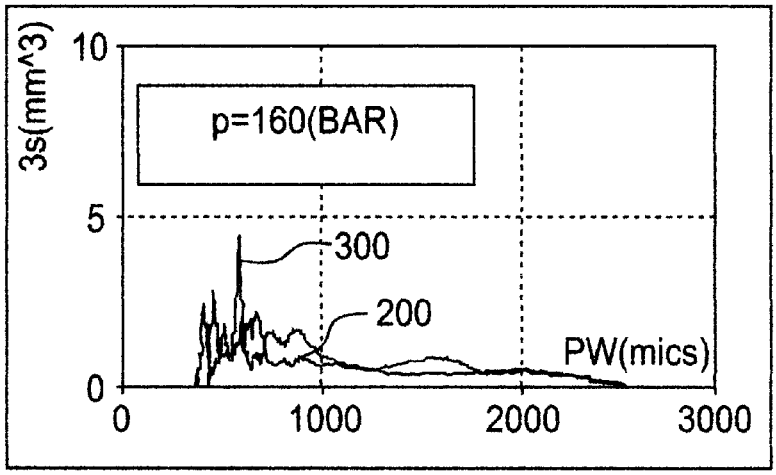
Figure 5J:
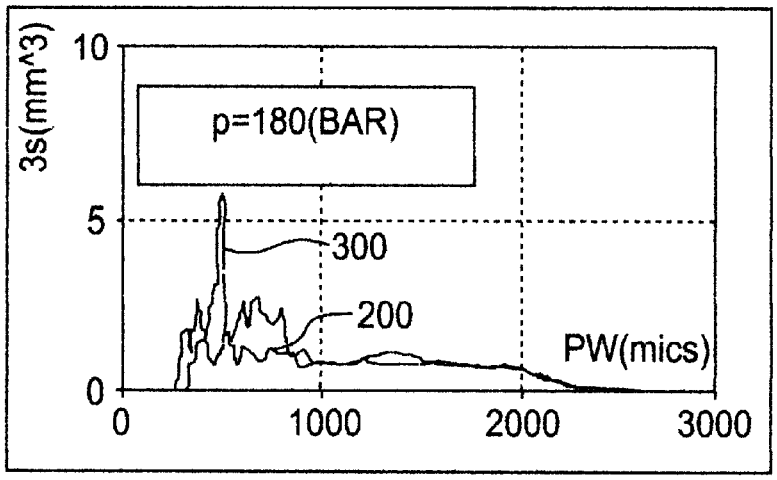
Figure 5K:
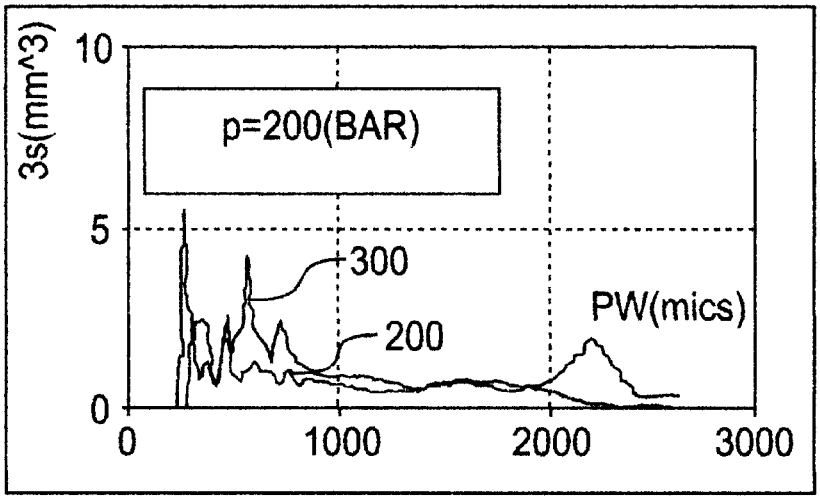
Figure 5L:
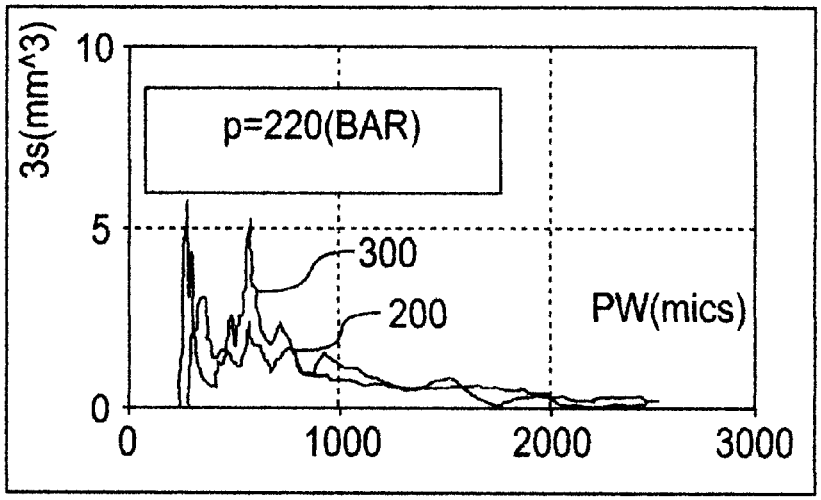
Figure 5M:
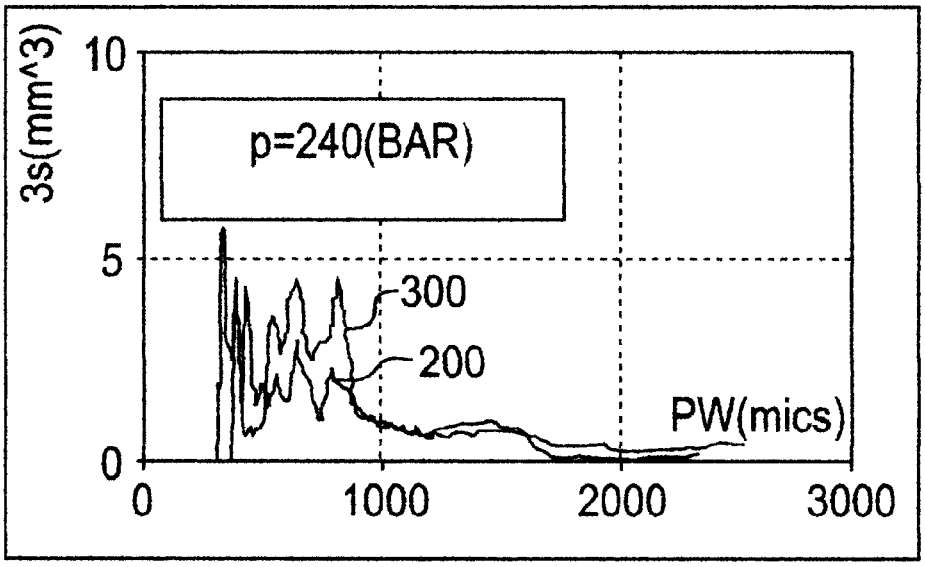

FIG. 4 shows the valve control body 102 with the spool 112 shifted in an open position (i.e., open stroke of the injector). In the open position, the grooves 108 of the valve control body 102 and the grooves 114 of the spool 112 are in alignment with one another thus allowing the working fluid 105 to flow from the inlet area 104 to the working ports 106 to the intensifier chamber. As discussed below, the pressure of the working fluid 105 urges the plunger 126 and intensifier piston 124 towards the high pressure chamber 136. This pressurizes the fuel within the high pressure chamber 136 which, in turn, forces the needle check valve 138 to shift against the needle spring 150 and open the injection holes in a nozzle tip. The fuel will then be injected into the combustion chamber of the engine.

As further seen from FIG. 4, in the open state, the working fluid 105 is displaced from the gap 121 through the notches 103. The working fluid 105 will then flow, preferably, into a reservoir. The working fluid 105 within the gap 121 reduces the speed (and hence bouncing) of the spool 112 during this cycle. That is, shortly before impact of the spool 112 on the open coil 116, a film of the working fluid 105 begins to separate and the working fluid 105 begins to compress between the spool 112 and the open coil 116, and preferably within the damping groove 112*a*. The compression of the working fluid 105 provides a significant reduction of the impact of the spool 112 on the open coil 116. This reduces the shot to shot fuel variations as well as reduces wear on the injector assembly, itself.

FIGS. 5*a*–5*m* show charts depicting several tests of a conventional fuel injector (of known design) and the oil activated fuel injector using the spool/valve control body of the present invention at several testing pressures ranging from 40 bars to 240 bars. The lines 200 depict the results relating to the oil activated fuel injector of the present invention and lines 300 depict the results of the conventional fuel injector. The test parameters included:

1. Engine speed: 1000 RPM
2. Pump speed: 1000 RPM
3. Engine Oil Temperature: approximately 75° Celsius
4. Calibration Fluid Temperature: approximately 40° Celsius.

FIGS. 5*a*–5*m* clearly show that the performance of the oil activated fuel injector described with reference to FIG. 1 is superior to that of a conventional fuel injector (i.e., a fuel injector which does not reduce the spool speed in the open state) throughout a range of testing pressures. This superior performance is attributed to the fact that the oil activated fuel injector of the present invention substantially prevents bouncing of the spool. This is a result of the working fluid dampening the impact of the spool 112 on the open coil 116.

FIGS. 6 shows a the pulse-width-diagram comparing the oil activated fuel injector described with reference to FIG. 1 to a conventional fuel injector. FIG. 6 uses the same test parameters and designations of FIGS. 5*a*–5*m*. In FIG. 6 it is shown that the fuel injector of the present invention shows more straighten traces and thus a superior performance as compared to the conventional fuel injection. The use of the oil activated fuel injector of the present invention leads to a reduction of the injector to injector variation, as well as a significant reduction of mechanical noise and wear.

Operation of the Oil Activated Fuel Injector of the Present Invention

In operation, a driver (not shown) will first energize the open coil 116. The energized open coil 116 will then shift the spool 112 from a start position to an open position. During this shifting, the working fluid within the gap 121 will compress thus reducing the speed of the spool and hence the impact of the spool 112 against the open coil 116.

In the open position, the grooves 108 of the valve control body 102 will become aligned with the grooves 114 on the spool 112. The alignment of the grooves 108 and 114 will allow the pressurized working fluid to flow from the inlet area 104 to the working ports 106 of the valve control body 102. Once the pressurized working fluid is allowed to flow into the working ports 106 it begins to act on the piston 124 and the plunger 126. That is, the pressurized working fluid will begin to push the piston 124 and the plunger 126 downwards thus compressing the intensifier spring 128. As the piston 124 is pushed downward, fuel in the high pressure chamber 136 will begin to be compressed via the end portion 126*a* of the plunger. The compressed fuel will be forced through the bores 139, 144 and 146 and into the chamber 158 which surrounds the needle 156. As the plunger 126 is pushed downward, the fuel inlet check valve 138 prevents fuel from flowing out of the high pressure chamber 136 from the fuel area. As the pressure working ports 106 increases, the fuel pressure will rise above a needle check valve opening pressure until the needle spring 148 is urged upwards. At this stage, the injection holes are open in the nozzle 140 thus allowing fuel to be injected into the combustion chamber of the engine.

To end the injection cycle, the driver will energize the closed coil 118. The magnetic force generated in the closed coil 118 will then shift the spool 112 into the closed or start position which, in turn, will close the working ports 106 of the valve control body 102. That is, the grooves 108 and 114 will no longer be in alignment thus interrupting the flow of working fluid from the inlet area 104 to the working ports 106. At this stage, the needle spring 150 will urge the needle 156 downward towards the injection holes of the nozzle 140 thereby closing the injection holes. Similarly, the intensifier spring 128 urges the plunger 126 and the piston 124 into the closed or first position adjacent to the valve control body 102. As the plunger 126 moves upward, the pressure release hole 132 will determine the start point of compression such that compression in the high pressure chamber 136 will begin when the plunger 126 completely covers the pressure release hole 132. Fuel will flow into the high pressure chamber 136 (via the fuel inlet check valve 138). Now, in the next cycle the fuel can be compressed in the high pressure chamber 136.

As the plunger 126 and the piston 124 move towards the valve control body 102, the working fluid will begin to be vented through the vent holes 110, as well as be forced through the fluid paths 115 and 119 (e.g., holes 115 and passage 119) into the gap 121 between the end of the spool 112 and the open coil 116. Now, in the next cycle when the open coil 116 is energized the spool 112 will begin to move towards the open coil 116. Again, the working fluid within the gap 121 will dampen the impact of the spool 112 on the open coil 116. No additional consumption of working fluid is required. More specifically, the compression of the working fluid within the gap 121, via the movement of the spool 112 towards the open coil 116, will reduce the speed and hence impact of the spool 112 on the open coil 116. This reduced speed and/or impact will, in turn, reduce or eliminate the bouncing of the spool 112 during this cycle. This reduces the shot to shot fuel variations as well as reduces wear on the injector assembly, itself.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A valve control body adapted for use with a fuel injector, comprising:

an inlet area;

working ports in fluid communication with the inlet area;

a spool having at least one communication port which provides fluid communication between the inlet area and the working ports; and at least one fluid passage within the spool providing fluid communication between at least one of the working ports and a gap formed between the spool and a coil which is adapted to shift the spool, wherein the at least one fluid passage within the spool is at least one hole and a passageway extending within an inner portion of the spool to the gap, and the spool includes a longitudinal bore and the passageway is formed between a fastening device extending within the longitudinal bore and a surface of the longitudinal bore.

2. The valve control body of claim 1, wherein the at least one fluid passage within the spool provides fluid communication between the at least one of the working ports and the gap when the spool is shifted away from the coil.

3. The valve control body of claim 1, wherein the at least one fluid passage within the spool further provides fluid communication between the at least one communication port and the gap.

4. The valve control body of claim 3, wherein the coil is an open coil and the at least one of the working ports is provided on a side of the open coil.

5. The valve control body of claim 1, further comprising at least one vent hole in fluid communication with the working ports and the at least one fluid passage within the spool.

6. The valve control body of claim 1, wherein the at least one communication port is a groove.

7. A valve control body adapted for use with a fuel injector, comprising:

an inlet area;

working ports in fluid communication with the inlet area;

a spool having at least one communication port which provides fluid communication between the inlet area and the working ports;

at least one fluid passage within the spool providing fluid communication between at least one of the working ports and a gap formed between the spool and a coil which is adapted to shift the spool, wherein the gap is adapted to hold working fluid; and a notch proximate to the gap, the notch permitting working fluid to be dispensed from the gap when the spool compresses the working fluid against the coil.

8. The valve control body of claim 7, wherein the working fluid in the gap reduces the speed of the spool when shifted towards the coil and reduces an impact of the spool on the coil when the coil is energized.

9. The valve control body of claim 8, wherein the dampening groove of the spool further reduces the impact.

10. A valve control body adapted for use with a fuel injector, comprising:

an inlet area;

working ports in fluid communication with the inlet area;

a spool having at least one communication port which provides fluid communication between the inlet area and the working ports; and at least one fluid passage within the spool providing fluid communication between at least one of the working ports and a gap formed between the spool and a coil which is adapted to shift the spool, wherein the gap is adapted to hold working fluid, and a dampening groove positioned at an end of the spool and in contact with the working fluid, the dampening groove providing a dampening effect of the spool when shifted towards the coil.

11. The valve control body of claim 10, wherein the dampening groove is in fluid communication with the at least one fluid passage.

12. A valve control body for use with a fuel injector, comprising:

an oil inlet area;

at least one port in fluid communication with the oil inlet area, the at least one port adapted for transporting oil between the oil inlet area and an intensifier chamber of the fuel injector;

an aperture having at least one communication port positioned about a surface of the aperture, the at least one communication port providing a flow path for the oil between the at least one port and the oil inlet area;

a spool positioned within the aperture and slidable between a first position and a second position, the spool including at least one communication port which is in alignment with the at least one communication port of the aperture when the spool is in the first position;

a first coil positioned at a first end of the spool;

a second coil positioned at a second end of the spool;

at least one fluid passage provided in the spool, the at least one fluid passage providing a fluid passage for the oil between the least one communication port of the aperture and the spool and a gap formed between the first end of the spool and the first coil when the spool is shifted in the second position towards the second coil; and a dampening groove positioned at the second end of the spool and in fluid contact with the oil within the gap.

13. The valve control body of claim 12, wherein the at least one fluid passage is at least one hole and a passage positioned about a longitudinal axis of the spool.

14. A spool used with a control body for a fuel injector, the spool comprising:

a shaft having a first end and a second end;

a dampening groove at either of the first end or the second end of the shaft;

at least one fluid communication path provided about a portion of the shaft;

at least one longitudinal bore provided throughout the shaft; and at least one hole in fluid communication with the at least one longitudinal bore.

15. An oil activated fuel injector, comprising:

a valve control body, the control body including:

an oil inlet area;

at least one port in fluid communication with the oil inlet area;

an aperture having at least one communication port positioned about a surface of the aperture;

a spool positioned within the aperture and slidable between a first position and a second position, the spool including at least one communication port which is in alignment with the at least one communication port of the aperture when the spool is in the first position;

a first coil positioned at a first end of the spool;

a second coil positioned at a second end of the spool; and at least one fluid passage provided in the spool, the at least one fluid passage providing a fluid passage for the oil between the least one port and a gap formed between the first end of the spool and the first coil when the when the spool is moved in the second position towards the second coil; and a dampening groove positioned at the second end of the spool and in fluid contact with the oil within the gap;

an intensifier body mounted to the valve control body, the intensifier body including a centrally located bore and a shoulder;

a piston slidably positioned within centrally located bore of the intensifier body;

a plunger contacting the piston, the plunger having a first end, a second end and a shaft;

an intensifier spring surrounding the shaft of the plunger and further positioned between the piston and the shoulder of the intensifier body, the intensifier spring urging the piston and the plunger in a first position proximate to the valve control body;

a high pressure fuel chamber formed at the second end of the plunger;

a nozzle having a fuel bore in fluid communication with the high pressure chamber;

a needle positioned within the nozzle; and a fuel chamber surrounding the needle and in fluid communication with the fuel bore.

16. The fuel injector of claim 15, further comprising:

a check disk positioned below the intensifier body remote from the valve control body, wherein a combination of an upper surface of the check disk, the second end of the plunger and an interior wall of the intensifier body forms the high pressure chamber; and a fuel bore in fluid communication with the fuel bore of the nozzle.

17. The fuel injector of claim 15, further comprising:

a fuel inlet check valve positioned within the check disk and providing fluid communication between the high pressure chamber and a fuel area during an upstroke of the plunger; and a spring cage positioned between the nozzle and the check disk, the spring cage including a spring which is in biasing contact with the needle.

* * * * *